US007167134B2

(12) United States Patent
Minami et al.

(10) Patent No.: US 7,167,134 B2
(45) Date of Patent: Jan. 23, 2007

(54) ANTENNA UNIT AND WATCH HAVING THE ANTENNA UNIT

(75) Inventors: Narutoshi Minami, Mitaka (JP); Takashi Sano, Fussa (JP); Soh Kimura, Kodaira (JP); Tadashi Kotani, Tottori (JP)

(73) Assignee: Casio Computer Co., Ltd., Tokyo (JP)

( * ) Notice: Subject to any disclaimer, the term of this patent is extended or adjusted under 35 U.S.C. 154(b) by 63 days.

(21) Appl. No.: 10/996,258

(22) Filed: Nov. 23, 2004

(65) Prior Publication Data

US 2005/0116872 A1 Jun. 2, 2005

(30) Foreign Application Priority Data

Nov. 27, 2003 (JP) ..... 2003-398027

(51) Int. Cl.
*H01Q 1/12* (2006.01)

(52) U.S. Cl. ..... 343/718; 343/788; 343/866

(58) Field of Classification Search ..... 343/788, 343/787

See application file for complete search history.

(56) References Cited

U.S. PATENT DOCUMENTS 5,696,518 A 12/1997 Itoh et al.
6,657,922 B2 * 12/2003 Sato ..... 368/10
6,987,490 B2 * 1/2006 Sano ..... 343/788
2002/0044501 A1 4/2002 Sato
2004/0196201 A1 * 10/2004 Aisenbrey ..... 343/788
2005/0219139 A1 * 10/2005 Kimura et al. ..... 343/788
2005/0237254 A1 * 10/2005 Kato et al. ..... 343/788

FOREIGN PATENT DOCUMENTS

EP 0 703 513 A1 3/1996
JP 06-350324 A 12/1994
JP 2000 105802 A * 4/2000
JP 2003-110341 A 4/2003

OTHER PUBLICATIONS

Patent Abstracts of Japan, vol. 2003, No. 4, Apr. 2, 2003 and JP 2002-372591 A (Mitsubishi Materials Corp.), Dec. 26, 2002—Abstract only.

* cited by examiner

*Primary Examiner*—Trinh Vo Dinh
(74) *Attorney, Agent, or Firm*—Frishauf, Holtz, Goodman & Chick, P.C.

(57) ABSTRACT

In one antenna unit, a non-electrically conductive resin layer is provided on a core portion of electrically conductive material and a winding portion is configured by a coil wound on the layer. The antenna unit is housed in a band attaching portion of a watch case of a watch, and a watch module is housed in the watch case. In another antenna unit, a core portion and a winding portion wound on the core portion are arranged in a cover case. Openings are formed in side walls of the cover case oppositely positioned to each other, and parts of the outer circumferential surface of the winding portion are arranged in the openings. The winding portion together with the core portion is supported to the inner surface of the cover case by adhesive portions interposed between the cover case and the winding portion.

10 Claims, 10 Drawing Sheets

ANTENNA UNIT AND WATCH HAVING THE ANTENNA UNIT

CROSS-REFERENCE TO RELATED APPLICATIONS

This application is based upon and claims the benefit of priority from prior Japanese Patent Application No. 2003-398027, filed Nov. 27, 2003, the entire contents of which are incorporated herein by reference.

BACKGROUND OF THE INVENTION

1. Field of the Invention

The present invention relates to an antenna unit and a watch having the antenna unit.

2. Description of the Related Art

An antenna unit for transmitting and receiving a radio wave is provided in an electronic apparatus such as a radio apparatus and a radio controlled watch. One type of conventional antenna unit as described in Japanese Patent Application KOKAI Publication No. 6-350324 includes an antenna main body, which is formed by metal plate having electrical conductivity, such as brass or copper plate, and which is plated with nickel. And, another type of conventional antenna unit includes a core portion, and a winding portion, which is formed by a coil wound on the insulating tape on the core portion.

When the core portion is formed by material, for example ferrite, having high magnetic permeability and high electrical conductivity, in the latter type of conventional antenna unit, there is a case that an electric current generated in the winding portion when the conventional antenna unit receives radio wave flows in the core portion thereby decreasing radio receiving efficiency of the conventional antenna.

In order to prevent such a drawback as described above from generating in the latter type of conventional antenna unit, an electrically insulating tape is wound on the core portion and the winding portion is formed by the coil wound on the insulating tape on the core portion. And, the insulating tape electrically insulates the winding portion from the core portion.

However, since the insulating tape wound on the core portion has a thickness of about 200 μm and makes its diameter being relatively large, the coil wound thereon needs a relatively large length and decreases its direct-current resistance characteristic, etc. In a case that the core portion has flanges for positioning the coil wound on the core portion at its both ends, the large diametrical insulating tape and the large diametrical coil needs to make the sizes of each flange increase so that the strength of each flange decreases.

BRIEF SUMMARY OF THE INVENTION

According to one aspect of the present invention, an antenna unit comprising: a core portion formed by material having electrical conductivity; a layer of non-electrically conductive resin provided on the core portion; and a winding portion configured by a coil wound on the layer of non-electrically conductive resin on the core portion.

According to another aspect of the present invention, an antenna unit comprising: an antenna cover case including side walls oppositely positioned to each other and openings formed in the side walls; a core portion arranged in the inner space of the antenna cover case; a winding portion wound on the core portion and having an outer circumferential surface, parts of the outer circumferential surface being arranged in the openings of the side walls of the antenna cover case; and a plurality of adhesive portions interposed between the inner surface of the antenna cover case and the outer circumferential surface of the winding portion and supporting the winding portion together with the core portion to the inner surface of the antenna cover case.

According to further aspect of the present invention, a watch comprising: a watch case including a band attaching portion for attaching a band; a watch module housed in the watch case; and an antenna unit housed in the band attaching portion, the antenna unit including a core portion formed by material having electrical conductivity, a layer of non-electrically conductive resin provided on the core portion, and a winding portion configured by a coil wound on the layer of non-electrically conductive resin on the core portion.

BRIEF DESCRIPTION OF THE SEVERAL VIEWS OF THE DRAWING

The accompanying drawings, which are incorporated in and constitute a part of the specification, illustrate an embodiment of the invention and a modification thereof, and together with the general description given above and the detailed description of the embodiment and modifications given below, serve to explain the principles of the invention.

DETAILED DESCRIPTION OF THE INVENTION

Hereinafter, embodiments of an antenna unit and a watch having the antenna unit, both according to the present invention, will be described in detail.

In the embodiments, a wristwatch will be explained as an example of the watch.

[A Structure of the Wristwatch]

Figure 1:
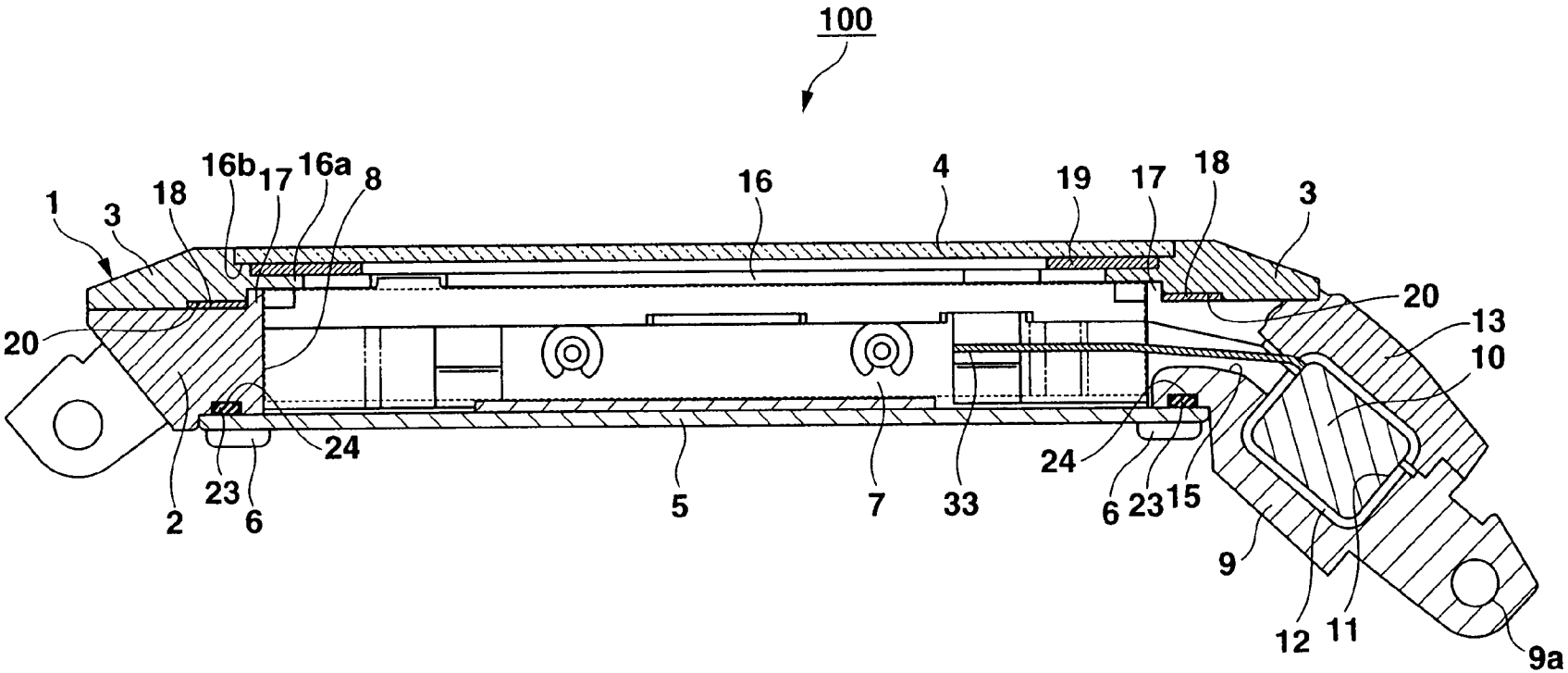
FIG. 1 is a vertical sectional view of a wristwatch having an antenna unit according to one embodiment of the present invention.

FIG. 1 is a vertical sectional view of the wristwatch 100. As shown in FIG. 1, the wristwatch 100 has a watch case 1. The watch case 1 comprises a case body 2 having a watch module accommodating space 8 in the center portion thereof, a bezel 3 attached on the top surface of the case body 2 to encircle a top opening of the watch module accommodating space 8 in the case body 2, a watch glass 4 fit to the bezel 3 to cover the top opening of the watch module accommodating space 8 in the case body 2, a metallic back cover 5 attached to the back surface of the case body 2 to cover an back opening of the watch module accommodating space 8 in the case body 2, and fastening screws 6 fastening the back cover 5 to the bezel 3 with the case body 2 being sandwiched therebetween. The fastening screws 6 are inserted into holes formed in the peripheral area of the back cover 5, are passed through holes formed in the case body 2 to extend from the back surface to the top surface thereof, and are screwed in blind screw holes formed in the back surface of the bezel 3.

The case body 2 is made of synthetic resin such as ABS resin, and has an extending portion 9 as a band attaching portion extended outward from the bezel 3. The extending portion 9 has an antenna accommodating space 11 opened to a top surface of the extending portion 9, and an antenna unit 10 is housed in the antenna accommodating space 11. The extending portion 9 further has a pair of holes 9*a*, into which both ends of a pin for attaching a band to the extending portion 9 are inserted.

The antenna unit 10 is wrapped by a shock absorbing member 12 such as rubber in the antenna accommodating space 11. The top opening of the antenna accommodating space 11 is covered by an antenna cover panel 13 made of synthetic resin, and the antenna cover panel 13 is attached to the top surface of the extending portion 9.

A communication path 15 is formed in the case body 2 and the extending portion 9 to communicate the antenna accommodating space 11 in the extending portion 9 with the watch module accommodating space 8 in the case body 2. A flexible circuit board 33 is arranged in the communication path 15 and electrically connects the antenna unit 10 in the antenna accommodating space 11 to the watch module 7 in the watch module accommodating space 8.

The bezel 3 is made of a metal having high strength, such as stainless steel, to configure a thin ring shape, and a center opening 16 of the bezel 3 corresponds to the top opening of the watch module accommodating space 8 in the case body 2. The bezel 3 is positioned at its predetermined position on the top surface of the case body 2 by fitting the center opening 16 of the bezel 3 on a ring-shaped positioning projection 17 extending along the periphery of the top opening of the watch module accommodating space 8 on the top surface of the case body 2 and projecting outward from the top surface.

A tape receiving recess 20 is formed in the bottom surface of the bezel 3, and a double-sided adhesive tape 18 having a thickness slightly larger than the depth of the tape receiving recess 20 is received in the tape receiving recess 20. The bezel 3 is adhered to the predetermined position on the top surface of the case body 2 by the double-sided adhesive tape 18.

An inner flange 16*a* is formed on the inner circumferential surface of the center opening 16 of the bezel 3 to project over the peripheral area of the top opening of the watch module accommodating space 8, and a step 16*b* is formed in the peripheral area of the center opening of the bezel 3 on the top surface thereof. A ring-shaped solar panel 19 is placed on the top surface of the inner flange 16*a*, and the outer peripheral area of the inner surface of the watch glass 4 is placed on the top surface of the ring-shaped solar panel 19.

The outer peripheral area of the top surface of the watch module 7 in the watch module accommodating space 8 of the case body 2 is in contact with the back surface of the inner flange 16*a*.

The back cover 5 is made of a metal having high strength, such as stainless steel and titanium, to configure a thin flat plate. A waterproof ring 23 is arranged in a ring-shaped groove 24 formed in the back surface of the case body 2 to encircle the back opening of the watch module accommodating space 8. The back cover 5 fixed to the bezel 3 by the fastening screws 6 with the case body 2 being sandwiched therebetween presses the waterproof ring 23 to seal the gap between the back cover 5 and the back surface of the case body 2.

[A Structure of the Antenna Unit]

The antenna unit 10 comprises, as shown in FIGS. 2A to 4, an antenna main body 30, an antenna cover case 31 containing and protecting the antenna main body 30 from an external force applied thereto, adhesive portions 32 supporting the antenna main body 30 to the cover case 31, and the flexible circuit board 33 electrically connecting the antenna main body 30 of the antenna unit 10 to a circuit board (not shown) of the watch module 7.

Figure 5A:
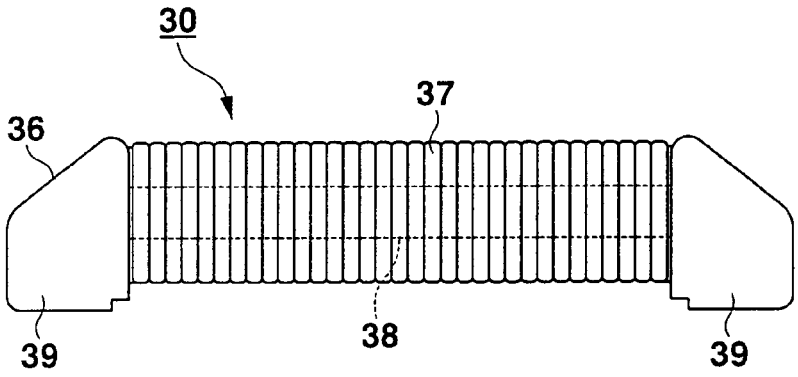
FIG. 5A is a bottom view of an antenna main body used in the antenna unit shown in FIG. 2A.
Figure 5B:
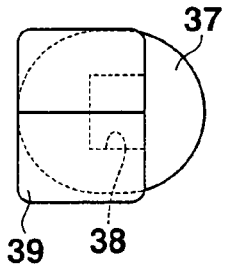
FIG. 5B is a side view of the antenna main body shown in FIG. 5A when the antenna main body is viewed from the right side thereof in FIG. 5A.
Figure 5C:
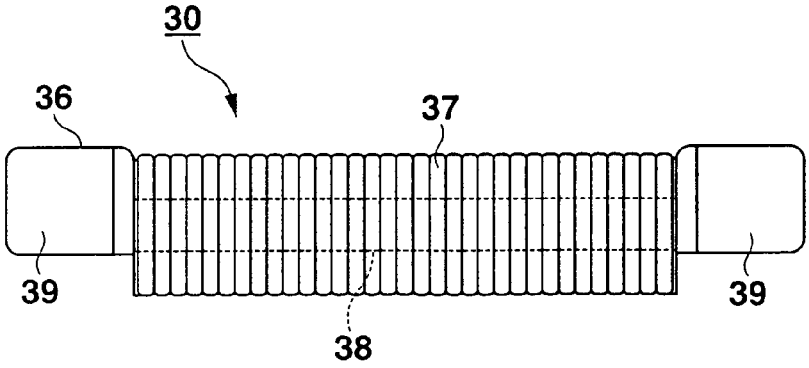
FIG. 5C is a front view of the antenna main body shown in FIG. 5A.

The antenna main body 30 includes a core portion 36 and a winding portion 37 configured by a coil wound around the core portion 36, as shown in FIGS. 5A to 5C. In this embodiment, the coil is made of copper.

Figure 6A:
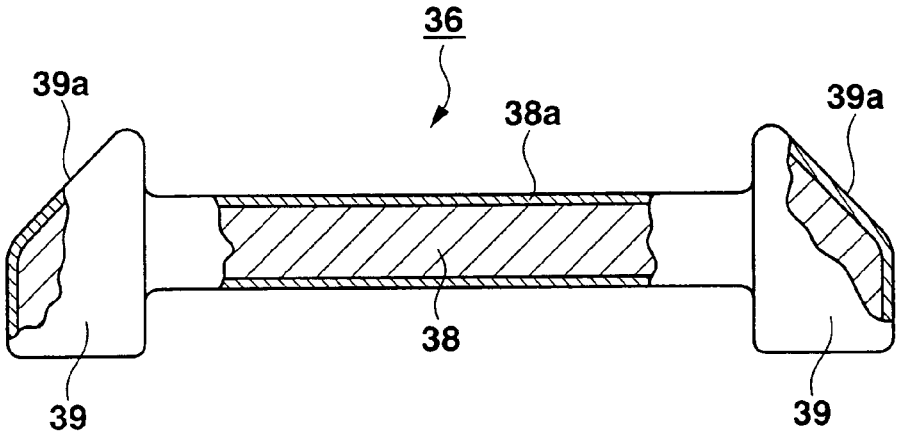
FIG. 6A is a bottom view of a core portion of the antenna main body shown in FIG. 5A.
Figure 6C:
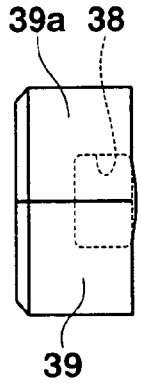
FIG. 6C is a side view of the core portion shown in FIG. 6A when the antenna main body is viewed from the right side thereof in FIG. 6A.
Figure 6B:
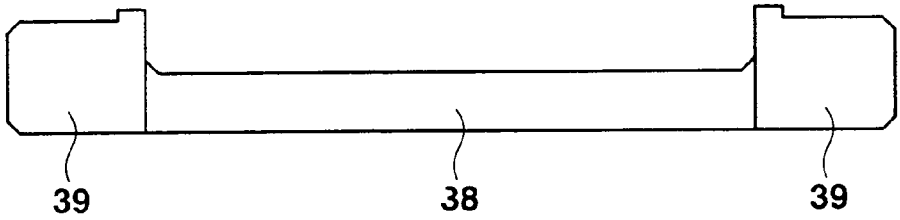
FIG. 6B is a front view of the core portion shown in FIG. 6A.
Figure 7A:
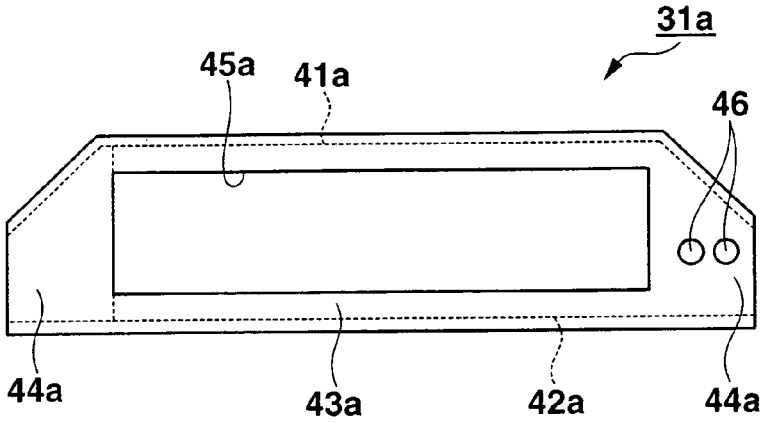
FIG. 7A is a top view of a top cover of a cover case used in the antenna unit shown in FIG. 2A.
Figure 7B:
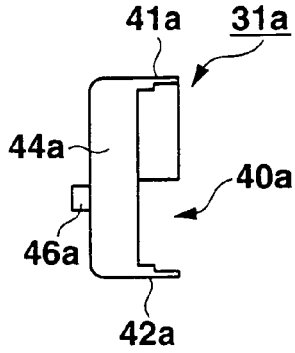
FIG. 7B is a side view of the top cover shown in FIG. 7A when the top cover is viewed from the right side thereof in FIG. 7A.
Figure 7C:
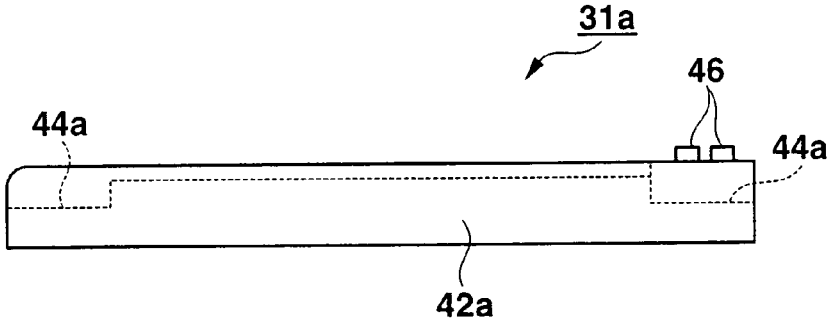
FIG. 7C is a front view of the top cover shown in FIG. 7A.
Figure 7D:
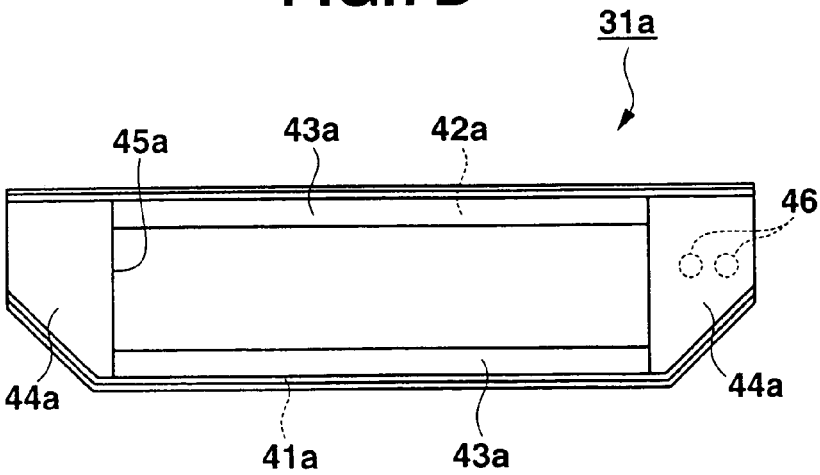
FIG. 7D is a bottom view of the top cover shown in FIG. 7A.
Figure 8A:
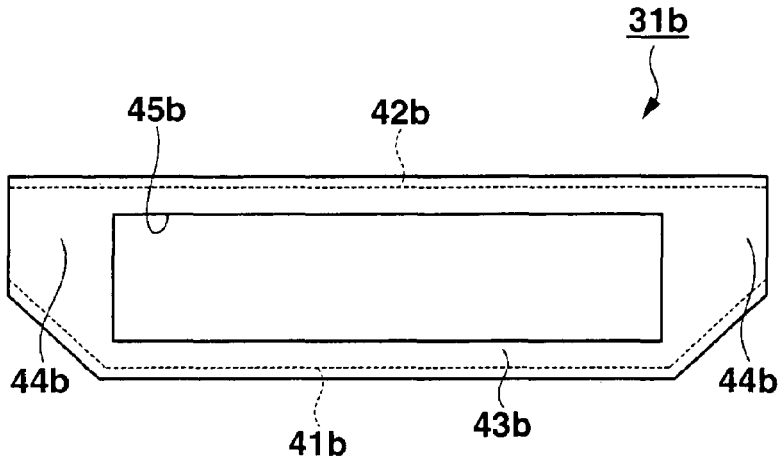
FIG. 8A is a bottom view of a bottom cover of a cover case used in the antenna unit shown in FIG. 2A.
Figure 8B:
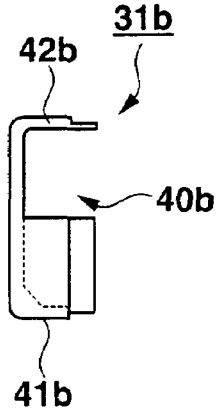
FIG. 8B is a side view of the bottom cover shown in FIG. 8A when the bottom cover is viewed from the right side thereof in FIG. 8A.
Figure 8C:
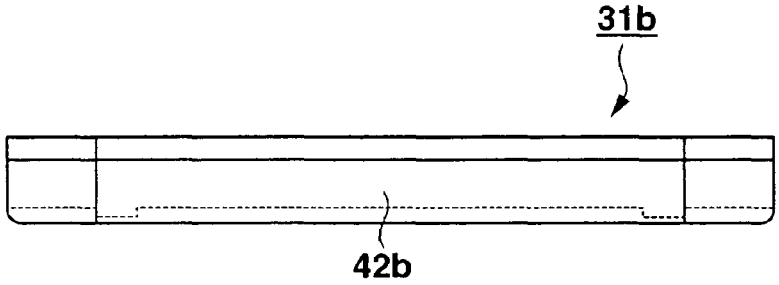
FIG. 8C is a rear view of the bottom cover shown in FIG. 8A.
Figure 8D:
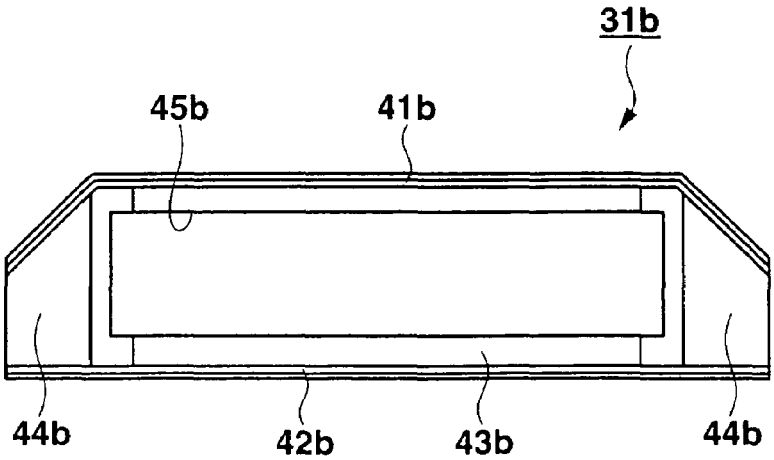
FIG. 8D is a top view of the bottom cover shown in FIG. 8A.

The core portion 36 has a square-rod-shaped center portion 38, the cross section of which is substantially rectangular as shown in FIGS. 6A to 6C, and end pieces 39 provided at both ends of the center portion 38. The center portion 38 and the end pieces 39 are formed by material having electrical conductivity and high radio wave receiving sensitivity such as for example a ferrite.

Each of the end pieces 39 has a shape formed by slanting one side surface of a rectangular parallelepiped, and the end pieces 39 are symmetrically arranged with each other relative to the center portion 38 such that slanted side surfaces 39*a* thereof are faced outwardly. The both ends of the center portion 38 are connected to predetermined positions on the side surfaces of the end pieces 39, the side surfaces facing each other. And, each of the predetermined positions is positioned at a center along one of two edges extending between the slanted side surface 39*a* and the other side surface facing oppositely to the slanted side surface 39*a* on each of the facing side surfaces.

A layer 36*a* of non-electrically conductive resin such as fluoroplastic is provided on the core portion 36 to the thickness ranging between about 20 μm and about 30 μm. In this embodiment, the layer 36*a* is coated on the core portion 36.

The winding portion 37 is formed by uniformly winding the coil on the area of the layer 36*a* provided on the square-rod-shaped center portion 38 between the end pieces 39, and the layer 36*a* electrically insulates the winding portion 37 from the core portion 36. In consideration of the above described function of the layer 36*a*, the layer 36*a* may be provided on at least the square-rod-shaped center portion 38 and the facing side surfaces of the end pieces 39 of the core portion 36. Further, in the case that the winding portion 37 will not in contact with the facing side surfaces of the end pieces 39, the layer 36*a* may be provided only on the square-rod-shaped center portion 38 of the core portion 36.

The antenna cover case 31 surrounds both of the core portion 36 and the winding portion 37 of the antenna main body 30, and is made of synthetic resin that allows a radio wave to transmit through it, such as polybutylene terephthalate (PBT).

The antenna cover case 31 includes two covers 31*a* and 31*b* detachably coupled to each other. One cover 31*a* covers the top side half of the outer peripheral surface of the antenna main body 30 and is called as a top cover in the followings. Another cover 31*b* covers the back side half of the outer peripheral surface of the antenna main body 30 and is called as a back cover in the followings.

The top cover 31*a* is shown well in FIGS. 7A to 7D, and has the inverted and angled U-shape in its cross section to provide a containing recess 40*a* for containing the top side half of the outer peripheral surface of the antenna main body 30. More specifically, the top cover 31*a* has a top side wall 43*a* having the substantially same top projecting shape as that of the top side half of the outer peripheral surface of the antenna main body 30. An outside dropping wall 41*a* is dropped down from the outside longitudinal edge of the inner surface of the side wall 43*a* and an inside dropping wall 42*a* is dropped down from the inside longitudinal edge of the inner surface of the side wall 43*a*. Each of the longitudinally positioned end areas 44*a* of the inner surface of the side wall 43*a* is configured to have a thickness being larger than that of the middle area of the inner surface of the side wall 43*a* between the longitudinally positioned end areas 44*a* thereof.

A rectangular shaped opening 45*a* is formed in the top side wall 43*a* such that both of the longitudinal edges thereof extend along the longitudinal direction of the antenna body 30, and the length of each longitudinal edge of the rectangular shaped opening 45*a* is the same as or longer than the longitudinal length of the winding portion 37 of the antenna body 30.

Therefore, when the top cover 31*a* is placed on the top side half of the outer peripheral surface of the antenna main body 30 to contain the top side half of the outer peripheral surface of the antenna main body 30 in the containing recess 40*a* of the top cover 31*a* and the longitudinally positioned end areas 44*a* of the inner surface of the top side wall 43*a* of the top cover 31*a* are placed on the top surfaces of the end pieces 39 of the core body 36, the top end part 37*a* of the outer circumferential surface of the winding portion 37 is arranged in the opening 45*a* of the top cover 31*a* so that the top end part 37*a* of the outer circumferential surface of the winding portion 37 is located in the same plane as that of the outer surface of the top side wall 43*a* of the top cover 31*a*.

Such an opening 45*a* of the top cover 31*a* as described above makes the height of the top cover 31*a*, that is the height of each of the outside and inside dropping walls 41*a* and 42*a*, which needs to contain the top side half of the outer peripheral surface of the antenna main body 30 in the containing recess 40*a* of the top cover 31*a*, decrease by the size corresponding to the thickness L1 of the middle area of the top side wall 43*a* of the top cover 31*a*. The opening 45*a* further promotes the dispersion of the heat generated by the winding portion 37 from the containing recess 40*a* of the top cover 31*a* to the outer space.

Figure 4:
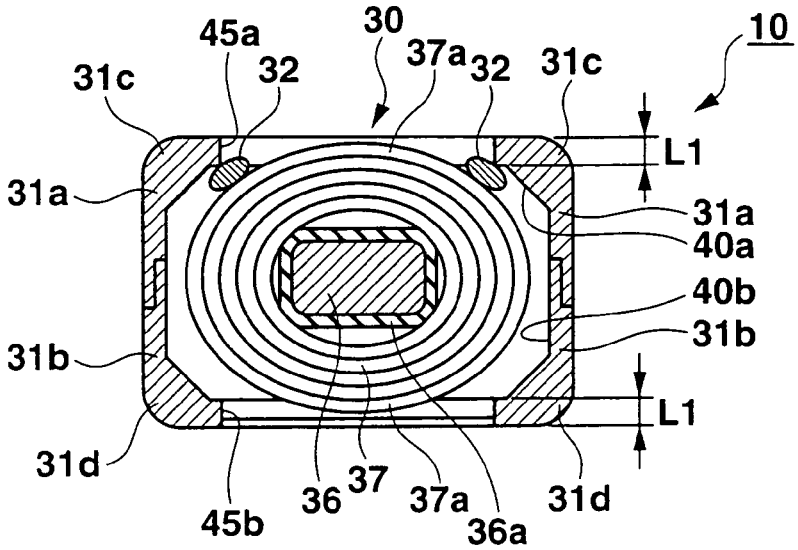
FIG. 4 is a cross sectional view of the antenna unit taken along a sectional line IV—IV in FIG. 2A.

As apparent from FIG. 4, each of the angled parts 31*c* located in both sides of the opening 45*a* in the cross section of the top cover 31*a* has the thickness, which is larger than that of each of the outside and inside dropping walls 41*a* and 42*a* and the top side wall 43*a*, to increase the strength of the top cover 31*a*.

The bottom cover 31*b* is shown well in FIGS. 8A to 8D, and has the angled U-shape in its cross section to provide a containing recess 40*b* for containing the bottom side half of the outer peripheral surface of the antenna main body 30. More specifically, the bottom cover 31*b* has a bottom side wall 43*b* having the substantially same bottom projecting shape as that of the bottom side half of the outer peripheral surface of the antenna main body 30. An outside standing-up wall 41*b* is stood up from the outside longitudinal edge of the inner surface of the bottom side wall 43*b* and an inside standing-up wall 42*b* is stood up from the inside longitudinal edge of the inner surface of the bottom side wall 43*b*. Each of the longitudinally positioned end areas 44*b* of the inner surface of the bottom side wall 43*b* is configured to have the same thickness as that of the middle area of the inner surface of the bottom side wall 43*b* between the longitudinally positioned end areas 44*b* thereof.

Another rectangular shaped opening 45*a* is formed in the bottom side wall 43*b* such that both of the longitudinal edges thereof extend along the longitudinal direction of the antenna body 30, and the length of each longitudinal edge of the rectangular shaped opening 45*a* is the same as or longer than the longitudinal length of the winding portion 37 of the antenna main body 30*a*.

Therefore, when the bottom cover 31*b* is applied on the bottom side half of the outer peripheral surface of the antenna main body 30 to contain the bottom side half of the outer peripheral surface of the antenna main body 30 in the containing recess 40*b* of the bottom cover 31*b* and the longitudinally positioned end areas 44*b* of the inner surface of the bottom side wall 43*b* of the bottom cover 31*b* are fitted on the bottom surfaces of the end pieces 39 of the core body 36, the bottom end part 37*a* of the outer circumferential surface of the winding portion 37 is arranged in the opening 45*b* of the bottom cover 31*b* so that the bottom end part 37*a* of the outer circumferential surface of the winding portion 37 is located in the same plane as that of the outer surface of the side wall 43*b* of the bottom cover 31*b*.

Such an opening 45*b* of the bottom cover 31*b* as described above makes the height of the bottom cover 31*b*, that is the height of each of the outside and inside standing-up walls 41*b* and 42*b*, which needs to contain the bottom side half of the outer peripheral surface of the antenna main body 30 in the containing recess 40*b* of the bottom cover 31*b*, decrease by the size corresponding to the thickness L1 of the middle area of the bottom side wall 43*b* of the bottom cover 31*b*. The opening 45*a* further promotes the dispersion of the heat generated by the winding portion 37 from the containing recess 40*b* of the bottom cover 31*b* to the outside thereof.

As apparent from FIG. 4, each of the angled parts 31*d* located in the outside and inside of the opening 45*a* in the cross section of the bottom cover 31*b* has the thickness, which is larger than that of each of the inside and outside standing-up walls 41*b* and 42*b* and the bottom side wall 43*b*, to increase the strength of the bottom cover 31*b*.

As described above, the antenna cover case 31 of this embodiment includes the rectangular cross section having the four angled parts 31*c*, 31*c*, 31*d* and 31*d* and the top and bottom side walls 43*a* and 43*b*, one of which is arranged between the two angled parts 31*c* and 31*c*, and another of which is arranged between the two angled parts 31*d* and 31*d*. The top and bottom side walls 43*a* and 43*b* are oppositely positioned to each other, and the openings 45*a* are formed in the top and bottom side walls 43*a* and 43*b*. The top end and bottom end parts 37*a* of the outer circumferential surface of the winding portion 37 are arranged in the openings 45*a*. Each of the two angled parts 31*c* and 31*c* located in both sides of the opening 45*a* of the top side wall 43*a* in the cross section of the antenna cover case 31 has the thickness, which is larger than that of the top side wall 43*a*. Also, each of the two angled parts 31*d* and 31*d* located in both sides of the opening 45*a* of the bottom side wall 43*b* in the cross section of the antenna cover case 31 has the thickness, which is larger than that of the bottom side wall 43*b*.

However, according to one aspect of the invention, the antenna cover case 31 may includes a multi-angular cross section having angled parts and side walls arranged therebetween, openings formed in two side walls oppositely positioned to each other, parts of the outer circumferential surface of the winding portion 37 are arranged in the openings, and each of the angled parts located in both sides of each opening in the cross section has a thickness, which is larger than that of each of the side walls.

Each of the adhesive portions 32 is epoxy adhesive. And, in this embodiment, four adhesive portions 32 are arranged at four points on the inside angular position 31*c* of the inner surface of the top cover 31*a* such that two of the four points are located at both longitudinal ends of the inside longitudinal edge of the opening 45*a* in the top side wall 43*a* of the top cover 31*a* and the remaining two points are equidistantly located to each other between the both longitudinal ends of the inside longitudinal edge of the opening 45*a* as shown by L2 in FIG. 3. Further, other four adhesive portions 32 are arranged at four points on the outside angular position 31*c* of the inner surface of the top cover 31*a* such that two of the four points are located at both longitudinal ends of the outside longitudinal edge of the opening 45*a* in the top side wall 43*a* of the top cover 31*a* and the remaining two points are equidistantly located to each other between the both longitudinal ends of the outside longitudinal edge of the opening 45*a* as shown by L2 in FIG. 3.

That is, each of the eight adhesive portions 32 is interposed between each of the above described eight points at the inside and outside angled parts 31*c* on the inner surface of the top cover 31*a* and each of the eight points on the top side half of the outer circumferential surface of the winding portion 37 corresponding to the above described eight points at the angled parts 31*c* on the inner surface of the top cover 31*a*, and the eight adhesive portions 32 supports the top side half of the outer circumferential surface of the winding portion 37 to the inner surface of the top cover 31*a* of the antenna cover case 31 as shown in FIG. 4.

Figure 2A:
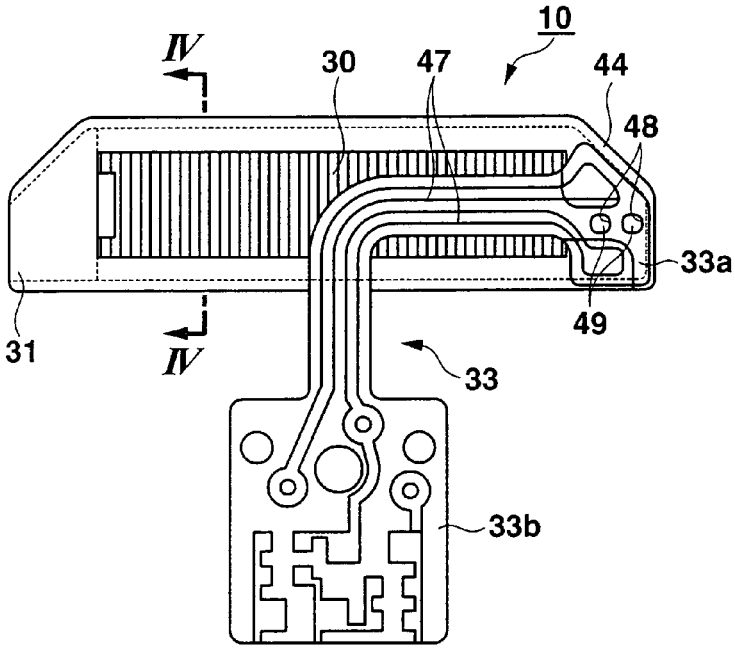
FIG. 2A is a top view of the antenna unit shown in FIG. 1.
Figure 2B:
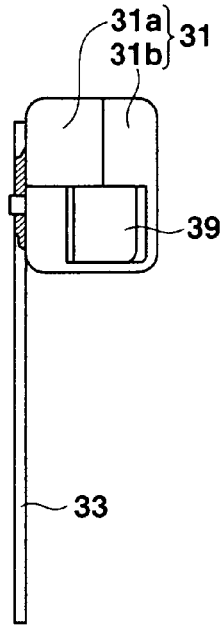
FIG. 2B is a side view of the antenna unit shown in FIG. 2A when the antenna unit is viewed from the right side thereof in FIG. 2A.

As shown in FIG. 2A, the flexible circuit board 33 has an outside end portion 33*a* attached to one of the both longitudinal ends of the top surface of the top cover 31*a*, and extends from the one longitudinal end of the top surface of the top cover 31*a* to the center of the opening 45*a* in the top cover 31*a* in the longitudinal direction thereof, and then is bent toward the inner side of the top cover 31*a* to extend away from the top cover 31*a*. Two lead lines 47 are formed on the top surface of the flexible circuit board 33 and extend from the outside end portion 33*a* to the inside end portion 33*b*.

The inwardly extended portion of the flexible circuit board 33 extends in the communication path 15 shown in FIG. 1 from the antenna accommodating space 11 in the extending portion 9 to the watch module accommodating space 8 in the case body 2, and the inside end portion 33*b* of the flexible circuit board 33 is connected to a circuit board (not shown) of the watch module 7 so that the ends of the two lead lines 47 positioned at the inside end portion 33*b* are electrically connected to two terminals of circuit formed on the circuit board (not shown) of the watch module 7.

Two positioning holes 48 are formed in the outside end portion 33*a* of the flexible circuit board 33 as shown in FIG. 2A, and the ends of the two lead lines 47 positioned at the outside end portion 33*a* encircle the two positioning holes 48.

Two positioning pins 49 are formed on the one of the both longitudinal ends of the top surface of the top cover 31*a* as shown in FIGS. 2A, 2C, and 7A to 7D, and both ends of the coil of the winding portion 37 are exposed on the two positioning pins 49.

Figure 2C:
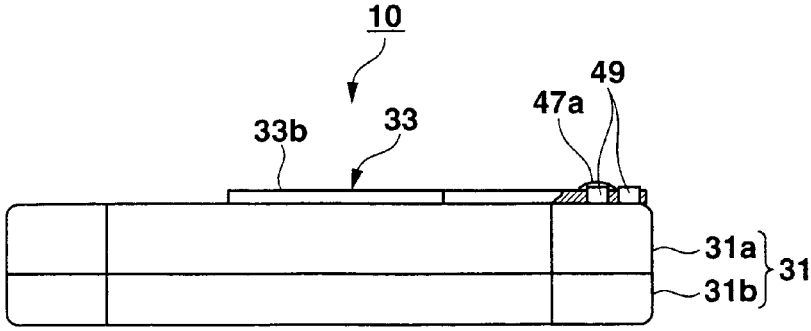
FIG. 2C is a front view of the antenna unit shown in FIG. 2A.
Figure 3:
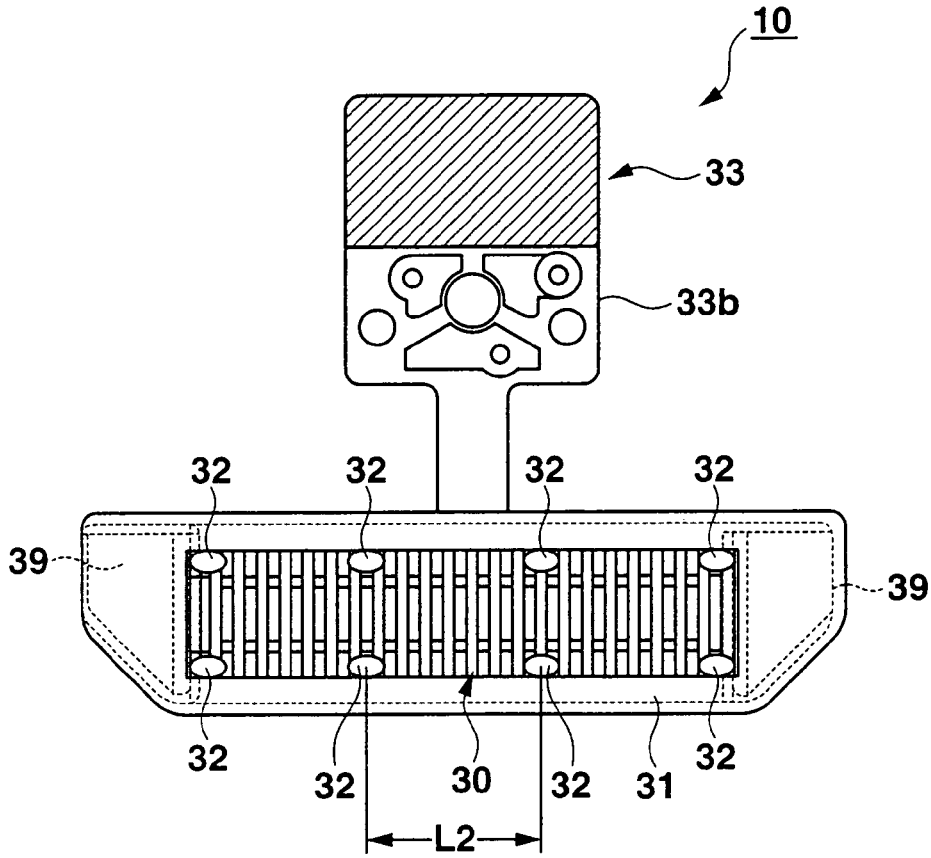
FIG. 3 is a bottom view of the antenna unit shown in FIG. 2A.

After the two positioning holes 48 in the outside end portion 33*a* of the flexible circuit board 33 are fitted on the two positioning pins 49 on the one of the both longitudinal ends of the top surface of the top cover 31*a*, the both ends of the coil of the winding portion 37 exposed on the two positioning pins 49 are electrically connected to the ends of the two lead lines 47 positioned at the outside end portion 33*a* and encircling the two positioning holes 48 by solder 47*a* as shown in FIG. 2C. At the same time, the solder 47*a* firmly fix the two positioning holes 48 in the outside end portion 33*a* of the flexible circuit board 33 to the two positioning pins 49 on the one of the both longitudinal ends of the top surface of the top cover 31*a*.

[A Structure of the Watch Module 7]

Figure 9:
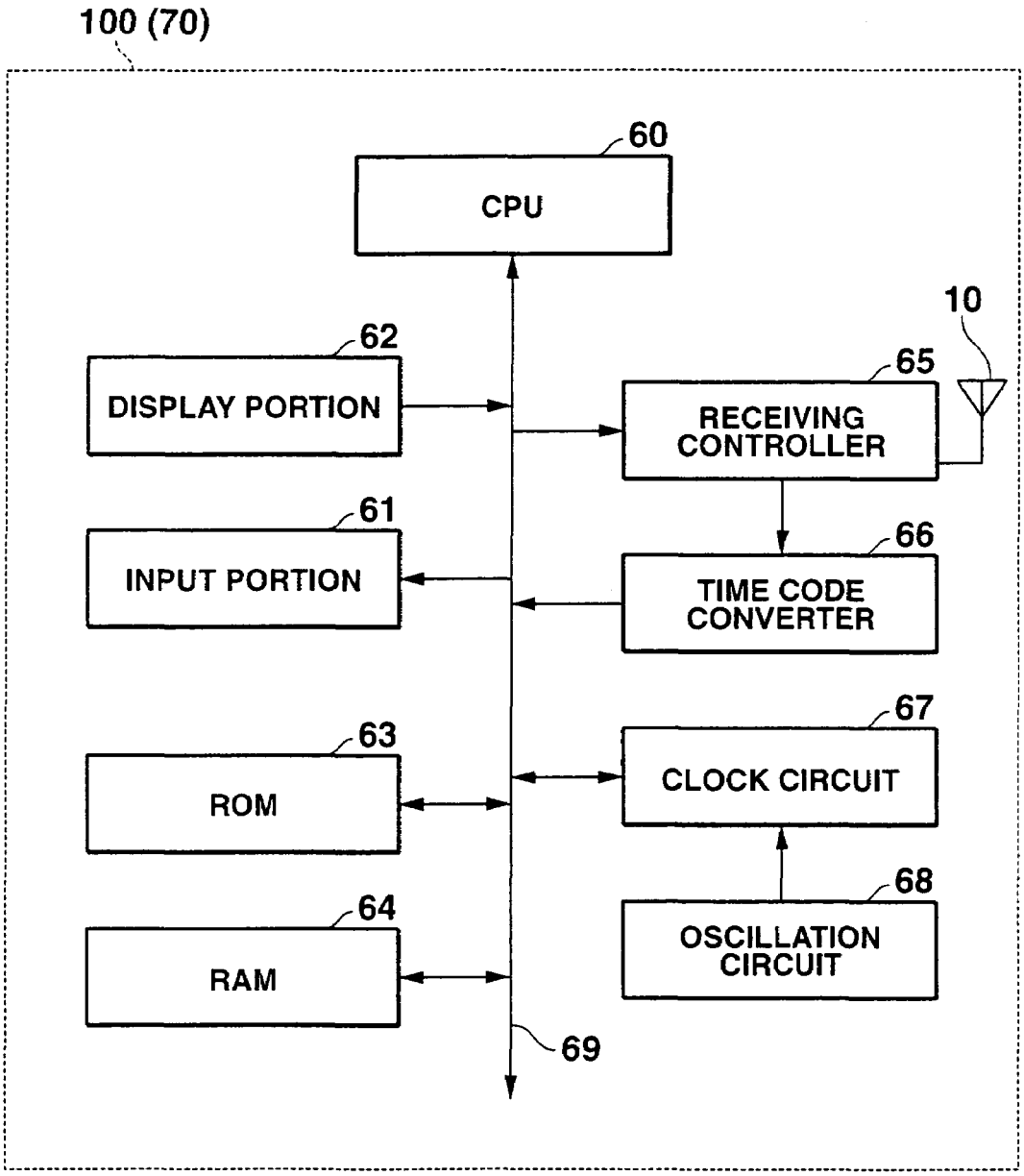
FIG. 9 is a block diagram of a watch module of the wristwatch shown in FIG. 1.

Now, the structure of the watch module 7 of the wristwatch 100 will be described with reference to FIG. 9.

FIG. 22 shows a block diagram of the watch module 7 including a radio wave receiver 70 operating with the antenna unit 10.

The watch module 7 comprises a CPU 60, an input portion 61, a display portion 62, a ROM 63, a RAM 64, a receiving controller 65, a time code converter 66, a clock circuit 67, and an oscillation circuit 68. The above described components of the watch module 7 excluding the oscillation circuit 68 are connected to a bus 69. The oscillation circuit 68 is connected to the clock circuit 67.

Figure 10:
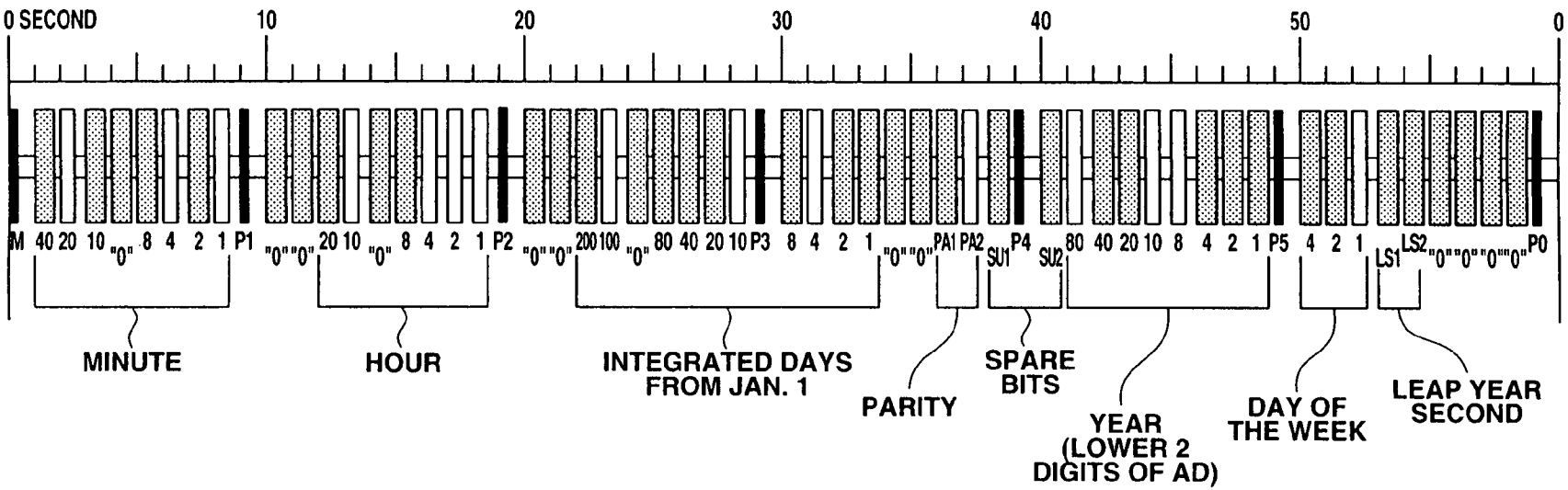
FIG. 10 is a format of a time code including radio wave received by the antenna unit of the wristwatch shown in FIG. 1.

The CPU 60 reads a predetermined program stored in the ROM 63 at a predetermined timing or according to the predetermined operation signal inputted through the input portion 61, develops the predetermined program in the RAM 64, and transfer instruction or data to each component of the watch module 7 on the basis of the predetermined program. Concretely, for example, the CPU 60 controls the receiving controller 65 at every predetermined time to execute the receiving operation of the standard time radio wave, and corrects the current time data counted by the clock circuit 67 in accordance with the standard time code shown in FIG. 10 and inputted into the clock circuit 67 from the time code converter 66.

The input portion 61 has switches or the like for instructing the CPU 60 to execute various functions of the watch module 7. When these switches or the like are operated, the signal corresponding to the operation of these switches or the like is outputted from these switches or the like to the CPU 60.

The display portion 62 includes a watch dial (not shown) and an analog time hands moving mechanism (not shown) controlled by the CPU 60, and displays the current time clocked by the clock circuit 67.

The ROM 63 stores the system program and application program for operating the watch module 7.

The RAM 64 is used as a work area of the CPU 60, and temporarily stores the program read from the ROM 63 and the data processed by the CPU 60.

The radio wave receiver 70 of the watch module 7 of the wrist watch 100 is operated with the antenna unit 10. The radio wave receiver 70 cuts off the unnecessary frequency components of the standard time radio wave received by the antenna unit 10, takes out the necessary frequency components for the standard time, and outputs an electric signal converted from the necessary frequency components to the time code converter 66.

The time code converter 66 converts the electric signal inputted from the radio wave receiver 70 to a digital signal, generates a standard code including the data necessary for the clock function, such as standard time code, integration code and day-of-the-week code, etc., and outputs the standard code to the CPU 60.

The clock circuit 67 counts the signal inputted from the oscillation circuit 68, clocks the current time, and outputs the clocked current time data to the CPU 60. The oscillation circuit 68 always outputs a clock signal with a certain frequency.

In the antenna unit 10 of this embodiment, the layer 36*a* of non-electrically conductive resin such as fluoroplastic is provided on the surface of the core portion 36 so that the winding portion 37 wound on the core portion 37 is electrically insulated from the core portion 37 by the layer 36*a*.

Thus, the current generated in the winding portion 37 when the winding portion 37 receives a radio wave does not flow in the core portion 36, and the radio wave receiving efficiency of the antenna unit 10 is improved.

Since the surface of the core portion 36 is electrically insulated not by the conventional insulating tape, which is thick such as 200 μm, but by the layer 36*a* of non-electrically conductive resin such as fluoroplastic, which can be made to thin such as 20 μm to 30 μm, the outer size of the antenna unit 10 can be decreased and also the length of the coil needed to configure the winding portion 37 can be decreased. Further, the direct current resistance characteristic of the winding portion 37 is improved.

Since the antenna cover case 31 surrounds both of the core portion 36 and the winding portion 37, both of the core portion 36 and the winding portion 37 are protected by the antenna cover case 31 from an external shock applied thereto. Therefore, the shock impact resistance of the antenna unit 10 can be improved.

Further, since the antenna cover case 31 is configured by combining the top cover 31*a* and the bottom cover 31*b* with each other, the accommodating of the core portion 36 and winding portion 37 into the antenna cover case 31 is easy.

Since each of the angled parts 31*c* and 31*d* of the antenna cover case 31 in its cross section is thicker than the other portions, the shock impact resistance of the antenna unit 10 can be improved furthermore.

Since the openings 45*a* and 45*b*, each of which has the longitudinal length being larger than that of the winding portion 37, are formed in the side walls opposed to each other in the antenna cover case 31 and further the core portion 36 and the winding portion 37 are accommodated in the antenna cover case 31 such that parts of the outer circumferential surface of the winding portion 37 are arranged in the openings 45*a* and 45*b*, the height of the antenna cover case 31 needed for accommodating the core portion 36 and the winding portion 37 therein can be decreased so that the height of the antenna unit 10 can be decreased.

Since the plurality of adhesive portions 32 are interposed between the inner surface of the antenna cover case 31 and the outer circumferential surface of the winding portion 37 and support the winding portion 37 together with the core portion 36 to the inner surface of the antenna cover case 31, the difference between the antenna cover case 31 and the winding portion 37 together with the core portion 36 in their deformations such as expansions and contractions caused by the change in temperature and/or humidity is absorbed by the adhesive portions 32 so that the winding portion 37 together with the core portion 36 will not be bent by the difference and the radio wave receiving characteristic will not be deteriorated.

Since the winding portion 37 of the antenna unit 10 is electrically connected to the watch module 7 by the flexible circuit board 33, the work needed for electrically connecting the winding portion 37 of the antenna unit 10 to the watch module 7 can be easily done.

Further, since the antenna unit 10 can be thin as described above, the wrist watch 100 using the antenna unit 10 can be also thin.

[Modifications of the Embodiment]

The present invention is not limited to the above mentioned embodiment.

For example, epoxy powder may be applied on the outer surface of the core portion 36 instead of providing the fuluoroplastic on the outer surface of the core portion 36. The shape of the antenna cover case 31 may be changed. The antenna cover case 31 may be divided into any number. The positions between the inner surface of the antenna cover case 31 and the outer circumferential surface of the winding portion 37 of the antenna main body 30, at which the adhesive portions 32 are interposed, may be changed. Further, the plurality of adhesive portions 32 may be interposed between the inner surface of the antenna cover case 31 and the outer peripheral surface of the core portion 36, instead of interposing the adhesive portions 32 between the inner surface of the antenna cover case 31 and the outer circumferential surface of the winding portion 37 of the antenna main body 30.

In this embodiment, the eight adhesive portions 32 are interposed between the inner surface of the antenna cover case 31 and the outer circumferential surface of the winding portion 37 of the antenna main body 30 at the eight predetermined positions. However, any number of adhesive portions 32 may be interposed between the inner surface of the antenna cover case 31 and the outer circumferential surface of the winding portion 37 of the antenna main body 30 at any number of predetermined positions.

Figure 11:
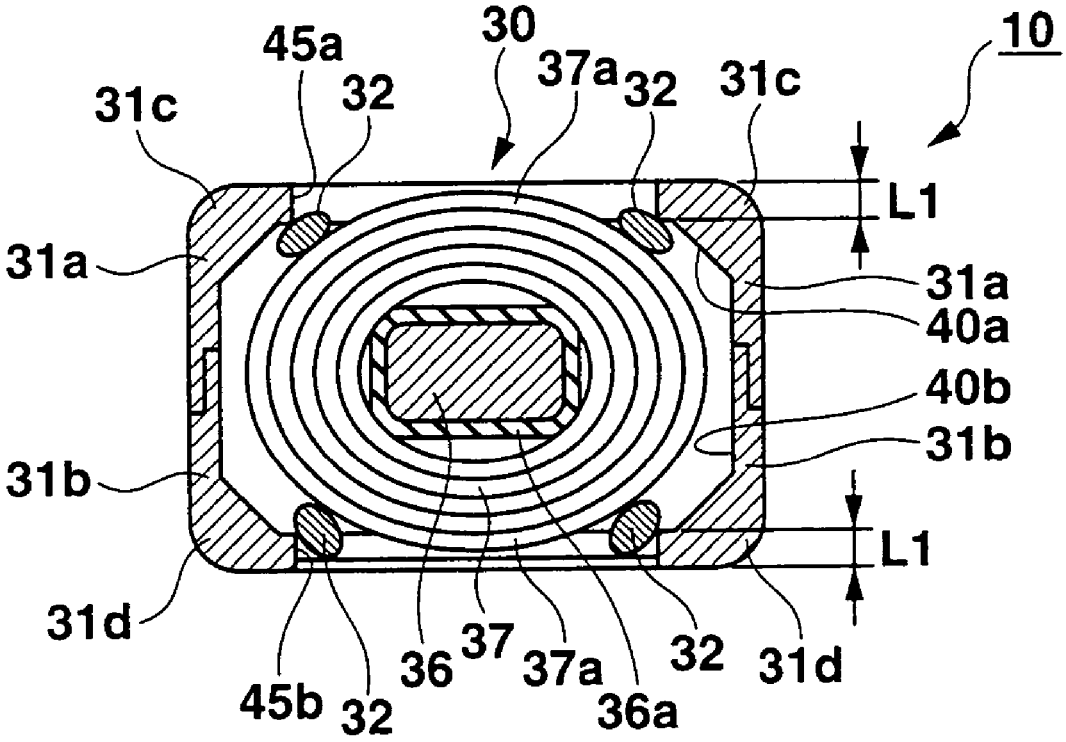
FIG. 11 is a cross sectional view of an antenna unit according to a modification of the embodiment of the present invention.

In this embodiment, the adhesive portions 32 are interposed between the angled parts 31*c* on the inner surface of the top cover 31*a* of the antenna cover case 31 and the top end part 37*a* of the top side half of the outer circumferential surface of the winding portion 37 of the antenna main body 30. However, the adhesive portions 32 may be further interposed between the angled parts 31*d* on the inner surface of the bottom cover 31*b* of the antenna cover case 31 and the bottom end part 37*b* of the bottom side half of the outer circumferential surface of the winding portion 37 of the antenna main body 30 at any predetermined positions as shown in FIG. 11.

What is claimed is:

1. An antenna unit comprising:

an elongate core portion;

a winding portion wound on an outer periphery of the core portion;

an antenna cover case which includes side walls positioned opposite to each other and an opening extending through a thickness of each of the side walls, and which encloses the core portion and the winding portion such that two opposite portions of an outer circumferential surface of the winding portion are projected into and provided in corresponding ones of the openings; and a plurality of adhesive portions arranged along an edge of at least one of the side walls of the antenna cover case, between the edge and a corresponding one of the opposite parts of the outer circumferential surface of the winding portion, said edge defining the opening in the at least one of the side walls;

wherein the adhesive portions are separated from each other with a predetermined gap therebetween and the adhesive portions fix the edge of the side wall of the antenna cover case to the corresponding one of the opposite parts of the outer circumferential surface of the winding portion.

2. The antenna unit according to claim 1, wherein each of the opposite parts of the outer circumferential surface of the winding portion is arranged in the corresponding one of the openings such that the opposite part is placed in a plane which includes an outer surface of the side wall in which the corresponding opening is provided.

3. An antenna unit comprising:

an elongate core portion formed of an electrically conductive material;

a winding portion comprising a coil wound on the core portion; and an antenna cover case which includes side walls positioned opposite to each other and an opening extending through a thickness of each of the side walls; p1 wherein each opening has a length that is at least as long as a longitudinal length of the winding portion, and the antenna cover case encloses the core portion and the winding portion such that two opposite portions of an outer circumferential surface of the winding portion are projected into and provided in corresponding ones of the openings.

4. The antenna unit according to claim 3, wherein a plurality of adhesive portions are arranged along an edge of at least one of the side walls of the antenna cover case, between the edge and a corresponding one of the opposite parts of the outer circumferential surface of the winding portion, and the edge defines the opening in the at least one of the side walls; and wherein the adhesive portions are separated from each other with a predetermined gap therebetween and the adhesive portions fix the edge of the side wall of the antenna cover case to the corresponding one of the opposite parts of the outer circumferential surface of the winding portion.

5. The antenna unit according to claim 3, wherein each of the opposite parts of the outer circumferential surface of the winding portion is arranged in the corresponding one of the openings such that the opposite part is placed in a plane which includes an outer surface of the side wall in which the corresponding opening is provided.

6. A watch comprising:

a watch case including band attaching portions; and an antenna unit housed in the watch case;

wherein the antenna unit comprises:

an elongate core portion;

a winding portion wound on an outer periphery of the core portion;

an antenna cover case which includes side walls positioned opposite to each other and an opening extending through a thickness of each of the side walls, and which encloses the core portion and the winding portion such that two opposite portions of an outer circumferential surface of the winding portion are projected into and provided in corresponding ones of the openings; and a plurality of adhesive portions arranged along an edge of at least one of the side walls of the antenna cover case, between the edge and a corresponding one of the opposite parts of the outer circumferential surface of the winding portion, said edge defining the opening in the at least one of the side walls;

wherein the adhesive portions are separated from each other with a predetermined gap therebetween and the adhesive portions fix the edge of the side wall of the antenna cover case to the corresponding one of the opposite parts of the outer circumferential surface of the winding portion.

7. The watch according to claim 6, wherein each of the opposite parts of the outer circumferential surface of the winding portion is arranged in the corresponding one of the openings such that the opposite part is placed in a plane which includes an outer surface of the side wall in which the corresponding opening is provided.

8. A watch comprising:

a watch case including band attaching portions; and an antenna unit housed in the watch case;

wherein the antenna unit comprises:

an elongate core portion formed of an electrically conductive material;

a winding portion comprising a coil wound on the core portion; and an antenna cover case which includes side walls positioned opposite to each other and an opening extending through a thickness of each of the side walls;

wherein each opening has a length that is at least as long as a longitudinal length of the winding portion, and the antenna cover case encloses the core portion and the winding portion such that two opposite portions of an outer circumferential surface of the winding portion are projected into and provided in corresponding ones of the openings.

9. The watch according to claim 8, wherein a plurality of adhesive portions are arranged along an edge of at least one of the side walls of the antenna cover case, between the edge and a corresponding one of the opposite parts of the outer circumferential surface of the winding portion, and the edge defines the opening in the at least one of the side walls; and wherein the adhesive portions are separated from each other with a predetermined gap therebetween and the adhesive portions fix the edge of the side wall of the antenna cover case to the corresponding one of the opposite parts of the outer circumferential surface of the winding portion.

10. The watch according to claim 8, wherein each of the opposite parts of the outer circumferential surface of the winding portion is arranged in the corresponding one of the openings such that the opposite part is placed in a plane which includes an outer surface of the side wall in which the corresponding opening is provided.

* * * * *